United States Patent [19]

Smith

[11] Patent Number: 4,761,190

[45] Date of Patent: Aug. 2, 1988

[54] METHOD OF MANUFACTURE OF A HEAT RESISTANT ALLOY USEFUL IN HEAT RECUPERATOR APPLICATIONS AND PRODUCT

[75] Inventor: Gaylord D. Smith, Huntington, W. Va.

[73] Assignee: Inco Alloys International, Inc., Huntington, W. Va.

[21] Appl. No.: 807,532

[22] Filed: Dec. 11, 1985

[51] Int. Cl.[4] ..... C22F 1/10

[52] U.S. Cl. ..... 148/11.5 R; 148/11.5 N; 148/427; 148/428; 148/442

[58] Field of Search ..... 148/11.5 N, 11.5 R, 148/2, 426–429, 442; 420/442, 445–454

[56] References Cited

U.S. PATENT DOCUMENTS

| | | | |
|---|---|---|---|
| 3,046,108 | 7/1962 | Elselstein | 420/448 |
| 4,102,709 | 7/1978 | Wenderott et al. | 148/11.5 N |

FOREIGN PATENT DOCUMENTS

| | | |
|---|---|---|
| 354818 | 1/1980 | Austria . |
| 091279 | 10/1983 | European Pat. Off. . |
| 455816 | 1/1928 | Fed. Rep. of Germany . |
| 1483041 | 1/1969 | Fed. Rep. of Germany . |
| 2080946 | 11/1971 | France . |
| 50-109119 | 8/1975 | Japan . |
| 1302994 | 1/1973 | United Kingdom . |

*Primary Examiner*—R. Dean

*Attorney, Agent, or Firm*—Raymond J. Kenny; Edward A. Steen

[57] ABSTRACT

A method of manufacturing nickel-iron-chromium alloys for use with recuperators. A combination of intermediate annealing, cold working and final annealing results in an alloy having a greater yield strength than a corresponding solution annealed material. The resultant alloy exhibits an isotropic structure and has high corrosion resistance, a low coefficient of expansion and high levels of ductility and strength.

15 Claims, No Drawings

METHOD OF MANUFACTURE OF A HEAT RESISTANT ALLOY USEFUL IN HEAT RECUPERATOR APPLICATIONS AND PRODUCT

TECHNICAL FIELD

This invention relates to a method of manufacture of nickel-iron-chromium alloys to enhance their performance in heat recuperator applications. Specifically, this invention describes a method for imparting additional strength which is critical to the successful use of these alloys in heat recuperators. The method is a combination of cold work and controlled annealing which results in the retention of part of the cold work while maintaining isotropic properties and high ductility.

BACKGROUND ART

Waste heat recovery devices improve the thermal efficiency of power generators and industrial heating furnaces. Substantial gains in the efficiency of energy usage can be realized if the energy in exhaust gases of such equipment can be used to preheat combustion air, preheat process feedstock or generate steam. One such device to utilize waste heat is the recuperator. A recuperator is a direct transfer type of heat exchanger where two fluids, either gaseous or liquid, are separated by a barrier through which heat flows. The fluids flow simultaneously and remain unmixed. There are no moving parts in the recuperator. Metals, because of their high heat conductivity, are a preferred material of construction provided that the waste heat temperature does not exceed 1600° F. (871° C.).

For a recuperator to provide long service life, conservative designs are required which adequately allow for the principal failure mechanisms. The principal failure mechanisms of metallic recuperators include:

(a) excessive stresses due to differential thermal expansion resulting from temperature gradients, thermal cycling and variable heat flow;
(b) thermal and low cycle fatigue;
(c) creep; and
(d) high temperature gaseous corrosion.

Many early recuperator designs did not take thermal expansion into account. This caused early failure due to excessive stresses created by the failure to allow for thermal expansion. However, as recuperator designs have been improved, the nature of the failure appears to have shifted away from thermally induced stresses and towards thermal fatigue and high temperature gaseous corrosion.

Because recuperators operate, at least in part, above 1000° F. (538° C.), recuperator alloys are subject to carbide and sigma phase precipitation with resulting reductions in ductility and resistance to crack propagation. Further, since sigma and carbides contain large amounts chromium, their formation will deplete chromium from the matrix and thereby accelerate high temperature gaseous corrosion.

Thermal fatigue is the result of repeated plastic deformation caused by a series of thermally induced expansions and contractions. Uniform metal temperature will, of course, minimize thermal fatigue. High thermal conductivity in the metal will minimize, but not eliminate, any existing thermal gradient. Resistance to thermal fatigue can also be enhanced by improving a material's stress rupture strength which is an objective of this invention.

High temperature gaseous corrosion will depend upon the nature of the fluid stream. Where the recuperator is used to preheat combustion air, one side of the barrier metal is subject to oxidation and the other side is subject to the corrosion of the products of combustion. Oxidation, carburization and sulfidation can result from the products of combustion. Nickel-iron-chromium base alloys containing 30–80% Ni, 1.5–50% Fe, 12–30% Cr, 0–10% Mo, 0–15% Co, 0–5% Cb+Ta, plus minor amounts of Al, Si, Cu, Ti, Mn and C, are gererally and adequately resistant to high temperature gaseous corrosion. Non-limiting examples would be for instance, INCONEL alloys 601, 617, 625, INCOLOY alloy 800, etc. (INCOLOY and INCONEL are trademarks of the Inco family of companies.) Preferably, alloys containing 50–75% Ni, 1.5–20% Fe, 14–25% Cr, 0–10% Mo, 0–15% Co, 0–5% Cb+Ta plus minor amounts of Al, Si, Cu, Ti, Mn and C, combine excellent high temperature gaseous corrosion resistance with high strength and thermal ccnductivity and low coefficients of expansion, which minimize thermal stresses due to temperature gradients.

For example, the high thermal conductivities of INCONEL alloys 617 and 625 are 94 (13.5) and 68 (9.8) BTU inch/ft$^2$-hr.°F. (watt/m-°K.) respectively. The low coefficients of expansion of these two alloys are $7.8\times10^{-6}$ ($1.40\times10^{-5}$) and $7.7\times10^{-6}$ ($1.34\times10^{-5}$) in/in-°F. (mm/mm-°K.).

These alloys possess an additional attribute which is a subject of this invention. These alloys can be cold worked and partially annealed to achieve an enhanced stress rupture strength which can be utilized without loss of this enhanced strength in recuperators operating at 600°–1500° F. (316°–816° C.). This additional strength aids resistance to thermal and low cycle fatigue, creep and crack propagation.

It is apparent that the combination of properties required for maintenance—free operation of a recuperator is restrictive. The material of construction must be intrinsically corrosion resistant, possess favorable heat transfer and expansion characteristics and have adequate strength and strength retention at the maximum use temperature. If the strength and strength retention is high, the wall thickness of the barrier may be minimized. This will enhance transfer of heat thus increasing overall thermal efficiency of the recuperator or, alternatively, if the heat transfer is adequate, permit reduction in the amount of material used in constructing the recuperator.

Unfortunately, conventional methods of manufacturing suitable alloy forms such as plate, sheet, strip, rod and bar do not result in products having the optimum physical and chemical characteristics. Conventional cold working of these alloy types result in a product generally too stiff and too low in ductility to be of use in recuperators even though they may have the appropriate tensile strength.

It should be clear that a method of manufacturing alloy forms possessing both the desired physical and chemical characteristics for use in very demanding environments is necessary.

SUMMARY OF THE INVENTION

Accordingly, this invention provides a method of manufacturing a recuperator material which maximizes the strength and strength retention inherent in a range of alloy compositions which possesses adequate high temperature corrosion resistance, high thermal conductivity and low coefficients of expansion. The instant invention does not adversely alter the published physical characteristics of the alloys. Moreover, concomitant with the enhanced strength and strength retention must be the retention of isotropic tensile properties and a high level of ductility. This method of manufacture can be accomplished using an alloy range of 30–80% Ni, 1.5–20% Fe, 12–30% Cr, 0–10% Mo, 0–15% Co, 0–5% Cb+Ta plus minor amounts of Al, Si, Cu, Ti, Mn and C. Preferably, the alloy range contains 50–75% Ni, 1.5–20% Fe, 14–25% Cr, 0–15% Co, 0–5% Cb+Ta plus minor amounts of Al, Si, Cu, Ti, Mn and C. An AOD (argon-oxygen-decarburization) or vacuum melt plus electroslag furnace remelted heat is conventionally processed to near final thickness, given an intermediate anneal which is about 50° F. (28° C.) less than the final anneal temperature and for a similar period of time, and then cold worked 20–80%, preferably 30–60%, and given a critical final anneal which partially anneals the product but retains an additional 20 to 80% increase in the yield strength over that of the solution annealed material. Additionally, the final anneal must retain at least 60% of solution annealed ductility as measured by the elongation of the sheet tensile specimen. The sheet product must also retain a high degree of isotropy. The final anneal temperature and time at peak temperature is dependent on the alloy composition, the degree of cold work and the properties being sought. However, the final peak anneal temperature is typically 1900°–2050° F. (1038°–1121° C.) for times of 10 to 90 seconds. This final anneal peak temperature and time combination results in a fine grain size of ASTM number 10 to 8. The final grain size enhances ductility and isotropy. The resulting product can be used to 1200°–1500° F. (649°–816° C.) and still retain the combination of properties which make it ideal for recuperator use. The peak service temperature would depend on the alloy and the degree of cold worked retained. A recuperator made with such a product of this invention would have maximum resistance to mechanical degradation due to thermal or low cycle fatigue, creep or high temperature gaseous corrosion.

PREFERRED MODE FOR CARRYING OUT THE INVENTION

A gas turbine engine manufacturer currently uses a recuperator to preheat the air of combustion to approximately 900° F. (482° C.) employing the engine exhaust gas as the source of heat. The typical exhaust gas temperature entering the recuperator is 1100° F. (593° C.). It is desirable to increase the temperature of the preheated air entering combustion. However, the recuperator is already experiencing cracking on the inner wall of the recuperator due to high stresses associated with thermal gradients in the recuperator. It would be difficult to find a stronger solid solution alloy that would possess the additional required ductility, high temperature corrosion resistance and fabricability.

The current recuperator was fabricated with solid solution INCONEL alloy 625 of the approximate composition 58% Ni, 9% Mo, 3.5% Cb+Ta, 5% Fe max, 22% Cr plus minor amounts of Al, Si, Ti, Mn and C. This alloy is known to cold work as sheet or plate in approximately the following manner:

| | 0.2% YS | | TS | | |
|---|---|---|---|---|---|
| Percent Reduction | Ksi | MPa | Ksi | MPa | Elong (%) |
| 0 | 50 | 345 | 116 | 800 | 67 |
| 5 | 78 | 538 | 121 | 834 | 58 |
| 10 | 103 | 710 | 130 | 896 | 48 |
| 15 | 113 | 779 | 137 | 944 | 39 |
| 20 | 125 | 862 | 143 | 986 | 32 |
| 30 | 152 | 1048 | 165 | 1138 | 17 |
| 40 | 167 | 1151 | 180 | 1241 | 13 |
| 50 | 177 | 1220 | 190 | 1310 | 9 |
| 60 | 181 | 1248 | 205 | 1413 | 7 |
| 70 | 201 | 1385 | 219 | 1510 | 5 |

Thus, practical amounts of cold working of the conventionally annealed alloy which would insure consistent and uniform tensile properties throughout the product would simultaneously result in a product too stiff to work and too low in ductility.

It was discovered that critical control of the final peak temperature of the anneal could allow consistent and uniform tensile properties to be achieved which were 20 to 80% higher than the presently used solution annealed product. These properties were isotropic and were retained to the peak temperature of the present use of the recuperator. Three examples of the use of the method of manufacture follow.

EXAMPLE I

An AOD melted and electroslag furnace remelted heat of the composition 8.5% Mo, 21.6% Cr, 3.6% Cb, 3.9% Fe, 0.2% Al, 0.2% Ti, 0.2% Mn, 0.03% C, Bal Ni (INCONEL alloy 625) was partially processed to 0.014 inches (0.36 mm) of thickness, intermediately annealed at 1900° F. (1038° C.) for 26 seconds and cold rolled 43% to 0.008 inches (0.2 mm) of thickness. When presented a choice, it is preferred to utilize the lowest temperature and the fastest time for the intermediate anneal.

The material was then annealed under the following three conditions to define the instant high strength isotropic sheet annealing procedure.

| No. | Temp (°F.) | Time at Peak Temp. (Seconds) |
|---|---|---|
| 1 | 1950 (1066° C.) | 43 |
| 2 | 1950 (1066° C.) | 29 |
| 3 | 1950 (1066° C.) | 26 |

| | Sample | Room Temp. 0.2% YS | | TS | | Prop. |
|---|---|---|---|---|---|---|
| No. | Direction | ksi | MPa | ksi | MPa | Elong (%) |
| 1 | Longitudinal | 72.3 | 498 | 140.0 | 965 | 45.5 |
| | Transverse | 73.5 | 507 | 138.0 | 951 | 50.0 |
| 2 | Longitudinal | 76.3 | 526 | 143.1 | 987 | 47.0 |
| | Transverse | 75.7 | 522 | 139.1 | 959 | 45.0 |
| 3 | Longitudinal | 74.6 | 514 | 141.1 | 972 | 44.5 |
| | Transverse | 75.4 | 520 | 139.4 | 961 | 50.0 |

The grain size of the above annealed materials was ASTM number 9. All the above annealing conditions yielded satisfactory material for use in the recuperator test program.

Previously, solution annealed conventional material of similar composition destined for current recuperators would be finally annealed at 2050° F. (1121° C.) for 15 to 30 seconds to yield the following properties:

| Sample Direction | 0.2% YS ksi | 0.2% YS MPa | TS ksi | TS MPa | Elong. (%) |
|---|---|---|---|---|---|
| longitudinal | 51.9 | 358 | 124.0 | 855 | 54.0 |
| transverse | 50.7 | 350 | 118.2 | 815 | 57.0 |

The resulting stress rupture life at 1200° F. (649° C.) and 90 ksi load is only 1.0 hours.

Contrast this state-of-affairs with the results achieved by the instant invention. The 1950° F. (1066° C.) annealed materials discussed above under the same test conditions had a stress rupture life of 24.0 hours. Thus under use conditions of a typical recuperator operating at 1200° F. (694° C.), the resistance of the 1950° F. (1066° C.) annealed material to stress induced by thermal gradients is considerably enhanced.

EXAMPLE II

A vacuum induction melted and electroslag furnace remelted heat of the composition 8.3% Mo, 21.8% Cr, 3.4% Cb, 3.7% Fe, 0.4% Al, 0.1 Ti, 0.09% Mn, 0.03% C, Bal Ni (INCONEL alloy 625) was partially processed to 0.014 inches (0.36 mm) of thickness, intermediate annealed at 1900° F. for 26 seconds and cold rolled 43% to 0.008 inches (0.2 mm) of thickness. The material was final annealed at 1950° F. (1066° C.) (peak temperature) for 26 seconds. The room temperature tensile properties were as follows:

| Location in coil | Longitudinal Direction 0.2% YS ksi | 0.2% YS MPa | TS ksi | TS MPa | Elong (%) |
|---|---|---|---|---|---|
| start | 73.8 | 509 | 139.8 | 964 | 47.0 |
| finish | 73.1 | 504 | 138.2 | 953 | 47.0 |
| | Transverse Direction 0.2% YS ksi | 0.2% YS MPa | TS ksi | TS MPa | Elong (%) |
| | 74.9 | 516 | 137.1 | 945 | 48.0 |
| | 73.7 | 508 | 135.0 | 931 | 49.5 |

The grain size of the material was ASTM number 9.5. Sufficient material was produced to manufacture a recuperator for test purposes. The material possessed a <111> texture oriented 60° from the plane of the sheet in the direction of rolling. The intensity of the texture was moderate.

EXAMPLE III

A vacuum induction melted and electroslag remelted heat of the typical composition 9.1% Mo, 12.4% Co, 22.2% Cr, 1.3% Al, 0.2% Ti, 1.1% Fe, 0.05% Mn, 0.1% C, Bal Ni (INCONEL alloy 617) was partially processed to 0.014 inches (0.36 mm) of thickness, intermediate annealed at 1900° F. (1038° C.) for 43 seconds and cold rolled 43% to 0.008 inches (0.2 mm) of thickness. The material was then annealed under the following three conditions to define a high strength isotropic sheet annealing procedure.

| No. | Temp (°F.) | Time at Peak Temp. (Seconds) |
|---|---|---|
| 4 | 1950 (1066° C.) | 43 |
| 5 | 1975 (1081° C.) | 44 |
| 6 | 2000 (1093° C.) | 48 |

Room Temp.

-continued

| No. | Sample Direction | 0.2 YS ksi | 0.2 YS MPa | TS ksi | TS MPa | Properties Elong. (%) |
|---|---|---|---|---|---|---|
| 4 | Longitudinal | 94.0 | 648 | 154.8 | 1067 | 32.5 |
| | Transverse | 93.7 | 647 | 152.0 | 1048 | 38.0 |
| 5 | Transverse | 91.3 | 629 | 147.5 | 1017 | 34.0 |
| 6 | Longitudinal | 71.0 | 489 | 137.0 | 944 | 37.0 |
| | Transverse | 74.0 | 510 | 138.0 | 951 | 41.0 |

The grain size of the material processed at 1950° F. (1066° C.) was less than ASTM number 10. The grains were difficult to distinguish and similar to that of cold worked material. The 1975° F. (1080° C.) anneal produced material with a distinguishable grain size of ASTM number 9.5 but the tensile properties were deemed to be less than optimum for recuperator service. The grain size of the material processed at 2000° F. (1093° C.) was ASTM number 9.5. The texture of the material was similar to that described in Example 2.

On the basis of the metallographic examination, the 2000° F. (1093° C.) anneal was chosen to produce sufficient material to produce a recuperator for test purposes. Accordingly, an additional sample was made. The processing of the material was identical to that described above. The 2000° F. (1093° C.) anneal yielded material with following room temperature tensile properties:

| Location in coil | Longitudinal Direction 0.2% YS ksi | 0.2% YS MPa | TS ksi | TS MPa | Elong. (%) |
|---|---|---|---|---|---|
| start | 78.6 | 542 | 147.8 | 1019 | 34.0 |
| finish | 75.3 | 519 | 147.3 | 1015 | 34.5 |
| | Transverse Direction 0.2% YS ksi | 0.2% YS MPa | TS ksi | TS MPa | Elong. (%) |
| | 78.2 | 539 | 143.6 | 990 | 39 |
| | 77.8 | 536 | 143.0 | 986 | 40 |

The grain size of the material was ASTM number 9.5. This composition in the solution annealed condition as sheet is typically 50.9 ksi (351 MPa) 0.2% YS, 109.5 ksi (755 MPa) TS and 58% elongation following a 2150° F. (1177° C.) anneal.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property of privilege is claimed are defined as follows:

1. A method of manufacturing a nickel-chromium-iron isotropic alloy form having high temperature corrosion resistance, high thermal conductivity, low coefficient of expansion, a high level of ductility and strength, the method comprising:

(a) processing an alloy heat to a form of near net shape;

(b) intermediately annealing the form;

(c) cold working the form 20–80%;

(d) finally annealing the form to retain a 20–80% increase in the yield strength over that of a solution annealed material of similar composition and retaining at least 60% of the solution annealed ductility.

2. The method according the claim 1 wherein the final anneal causes the form to have an ASTM grain size number ranging from 10 to 8.

3. The method according to claim 1 wherein the final anneal is conducted at about 1900°-2050° F. (1038°-1121° C.) for about 10-90 seconds.

4. The method according to claim 1 wherein the alloy includes about 30-80% nickel, about 1.5-20% iron, about 12-30% chromium, about 0-10% molybdenum, about 0-15% cobalt, about 0-5% columbium plus tantalum, and additional minor constituents.

5. The method according to claim 4 wherein the alloy includes about 50-75% nickel, about 1.5-20% iron, about 14-25% chromium, about 0-10% molybdenum, about 0-15% cobalt, about 0-5% columbium plus tantalum, and additional minor constituents.

6. The method according to claim 1 wherein the form is cold worked 30-60%.

7. The method according to claim 1 wherein the alloy form is fabricated into a recuperator.

8. The method according to claim 1 wherein the intermediate anneal occurs at a temperature approximately 50° F. (28° C.) less than the final anneal and for approximately the same time.

9. A recuperator consisting essentially of about 30-80% nickel, about 1.5-20% iron, about 12-30% chromium, about 0-10% molybdenum, about 0-15% cobalt, about 0-5% columbium plus tantalum and additional minor constituents having an isotropic structure, high temperature corrosion resistance, high thermal conductivity, a low coefficient of expansion and a high level of ductility and strength made by:

(a) processing an alloy heat of the above composition to a form of near net shape;
(b) intermediately annealing the form;
(c) cold working the form 20-80%;
(d) finally annealing the form to retain a 20-80% increase in yield strength over that of a solution annealed material of similar composition as well as retaining at least 60% of the solution annealed ductility; and
(e) fabricating the alloy into a recuperator.

10. The recuperator according to claim 9 wherein the final anneal is conducted at about 1900°-2050° F. (1038°-1121° C.) for about 10-90 seconds.

11. The recuperator according to claim 9 wherein the recuperator has an ASTM alloy grain size number ranging from 10-8.

12. The recuperator according to claim 9 wherein the form is cold worked 30-60%.

13. The recuperator according to claim 9 including about 50-75% nickel, about 1.5-20% iron, about 14-25% chromium, about 0-10% molybdenum, about 0-15% cobalt, about 0-5% columbium plus tantalum and additional minor constituents.

14. The recuperator according to claim 9 wherein the intermediate anneal occurs at a temperature approximately 50° F. (28° C.) less than the final anneal and for approximately the same time.

15. The recuperator according to claim 9 wherein the recuperator operates at a temperature range of about 600°-1500° F. (316°-816° C.).

* * * * *